US007316191B2

(12) United States Patent
Shomura et al.

(10) Patent No.: US 7,316,191 B2
(45) Date of Patent: Jan. 8, 2008

(54) FREE WORK PRESSING DEVICE FOR SEWING MACHINE

(75) Inventors: Eiichi Shomura, Tokyo (JP); Mikio Koike, Tokyo (JP); Masafumi Taoka, Tokyo (JP)

(73) Assignee: Janome Sewing Machine Co., Ltd., Tokyo (JP)

( * ) Notice: Subject to any disclaimer, the term of this patent is extended or adjusted under 35 U.S.C. 154(b) by 0 days.

(21) Appl. No.: 11/589,763

(22) Filed: Oct. 31, 2006

(65) Prior Publication Data

US 2007/0044697 A1 Mar. 1, 2007

(30) Foreign Application Priority Data

Aug. 11, 2005 (JP) ..... 2005-323452

(51) Int. Cl.
*D05B 29/12* (2006.01)
*D05B 35/00* (2006.01)

(52) U.S. Cl. ..... 112/235

(58) Field of Classification Search ..... 112/235, 112/236, 237, 238, 239, 240
See application file for complete search history.

(56) References Cited

U.S. PATENT DOCUMENTS 696,012 A * 3/1902 Dimond et al. ..... 112/235
1,452,687 A * 4/1923 Hemleb ..... 112/236
1,943,254 A * 1/1934 Barron ..... 112/236
3,796,173 A * 3/1974 Godsen ..... 112/235
4,292,907 A * 10/1981 Gilbride et al. ..... 112/236
5,564,355 A * 10/1996 Watson ..... 112/235
5,694,872 A * 12/1997 Zeller ..... 112/235

FOREIGN PATENT DOCUMENTS

JP 62-32549 8/1987

* cited by examiner

*Primary Examiner*—Ismael Izaguirre
(74) *Attorney, Agent, or Firm*—McGinn IP Law Group, PLLC

(57) ABSTRACT

A free work pressing device for a sewing machine includes a holding portion for mounting the free work pressing device to the presser bar of sewing machine, a slide shaft supported by the holding portion and being slidingly movable in the axial direction, a work pressing foot secured to the lower end of the slide shaft, an elastic member for normally pressing the slide shaft axially in the downward direction relative to the holding portion, an adjust mechanism for adjusting the vertical position of the work pressing foot relative to the work which is to be stitched. The work pressing foot is smoothly movable as yielding up and down in dependence upon a variation in the thickness of the work against and under control of the elastic member.

20 Claims, 11 Drawing Sheets

FREE WORK PRESSING DEVICE FOR SEWING MACHINE

BACKGROUND OF THE INVENTION

1. Field of the Invention

The present invention relates to a free work pressing device for sewing machine and more particularly relates to a work pressing device which is used in combination with a sewing machine in case so called the free kilt stitching operation is performed by use of a sewing machine. The free work pressing device is very simple in structure and very quiet in operation and is adapted to variation in the thickness of the work to be stitched.

2. Description of the Related Art

So far it has been prevalent to perform the free kilt stitching operation wherein the work is moved by hand under the work pressing foot in optional directions relative to the machine needle while the sewing machine is continuously driven. In the free kilt stitching operation, the work pressing device is something different from the one which is used in the normal stitching operation. The conventional work pressing device that is used for the free kilt stitching operation is mounted to the presser bar which is arranged adjacent the needle bar, and includes a holder for holding a slide shaft member that is slidingly movable in the vertical direction. The slide shaft member is normally pressed down by a coil spring and has a work pressing foot attached to the lower end thereof and normally pressed against the needle plate.

The slide shaft member is moved up and down with the needle bar that is moved up and down. Namely the work pressing foot is moved up and down in association with the up and down movement of the shaft member. Therefore the work is stitched as the work is moved in the optional directions while the work pressing foot is moved up. The conventional work pressing device is disclosed, for example, in the publication that is Japanese Utility Model Registration No. 62-32549, wherein the slide shaft member has the work pressing foot attached to the lower end thereof and is connected to the needle holder of the needle bar so as to be moved up and down as the needle bar is driven to move up and down.

SUMMERY OF THE INVENTION

However, since the slide shaft member disclosed in the Japanese Utility Model Registration No. 62-32549 is moved up and down by the needle bar that is driven to move up and down, the up and down movement is rather violent and produces loud noises. It is, therefore, problematical to set high the maximum rotation speed of sewing machine. Such limitation will often prevent the efficient stitching operation. Further since the work pressing foot is normally pressed against the needle plate by means of a spring, it is often difficult to stitch a rather thick work. which is placed between the work pressing foot and the needle plate. It is, therefore, an object of the invention to provide a free work pressing device for sewing machine which is very simple in structure and smooth in operation, particularly adapted to performing the free kilt stitching operation.

The inventors have made efforts to solve the problems of prior art and have come to provide an outcome. The invention as described in claim 1 is a free work pressing device for sewing machine substantially comprises a holding portion that is mounted to the presser bar of sewing machine, a slide shaft supported by the holding portion so as to be axially movable in vertical direction, a work pressing foot secured to the lower end of the slide shaft, an elastic member for normally pressing the slide shaft axially in the downward direction relative to the holding portion, an adjust mechanism for adjusting the vertical position of the slide shaft relative to the work which is to be stitched.

The invention as described in claim 2 is the free work pressing device for sewing machine, wherein the adjust mechanism comprises an upper threaded part of the slide shaft, an adjust screw member having an axially extended hole with an inner periphery that is threaded, the adjust screw member being in threaded engagement with the upper threaded part of the slide shaft and being rotated to move the slide shaft axially up and down relative to the work which is to be stitched. The invention as described in claim 3 is the free work pressing device for sewing machine, wherein the adjust mechanism includes a buffer arranged on the upper end of the holding portion and between the adjust screw member and the holding portion.

The invention as described in claim 4 is the free work pressing device for sewing machine, further comprising engaging means provided between the adjust screw member and the buffer to enable the adjust screw member to be intermittently rotated and to be held as stopped at an optional angular position.

The work pressing device for sewing machine of the invention may allow the sewing machine to have a maximum rotation speed which may be set rather high for efficient stitching operation without noises. This is because the work pressing device has the slide shaft which is not connected to the needle bar which is axially reciprocated for stitching the work, in contrast to the conventional work pressing device which has the slide shaft operatively connected to a pin of the needle holder of the needle bar so as to be axially reciprocated in association with the axial movement of the needle bar, the pin striking the slide shaft each time the needle bar goes up to move up the slide shaft and inevitably producing loud bump noises.

Further the work pressing device for sewing machine of the invention is very simple in structure because the adjust mechanism includes the adjust screw member which is in threaded engagement with the slide shaft at the upper part thereof so that the adjust screw member may be rotated to adjust the vertical position of the work pressing foot relative to the work to be stitched, the work pressing foot being secured to the lower end of the slide shaft.

Further since the adjust screw member is arranged on the buffer which is mounted to the upper end of the holding portion, the impact if applied to the slide shaft or to the work pressing foot or to the adjust screw member may be absorbed by the buffer. Thus the work pressing position will not be changed by the impact and further the work may be manipulated easily by hand under the work pressing foot with a light and constant force.

BRIEF DESCRIPTION OF THE ATTACHED DRAWINGS

FIG. 1A is a perspective view of a free work presser of sewing machine according to the invention. FIG. 1B is a side elevational view of the free work presser of sewing machine partly shown with imaginary lines. FIG. 1C is a front elevational view of the free work presser of sewing machine partly shown with imaginary lines. FIG. 1D is a plan elevational view of the free work pressing device for sewing machine partly shown with imaginary lines.

FIG. 2A is a perspective view of the free work pressing device for sewing machine shown as broken. FIG. 2B is a perspective view of an adjust screw member of the invention taken from below. FIG. 2C is a side elevational view of an essential part of an adjust mechanism of the invention shown in vertical section.

Figure 7A:
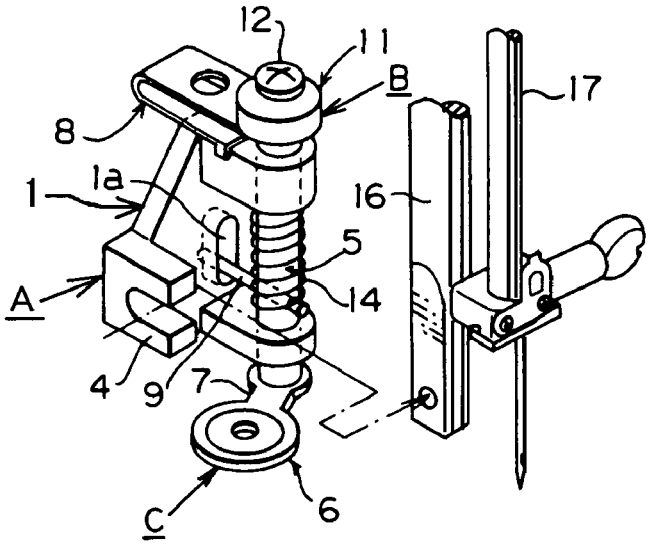
Figure 7B:
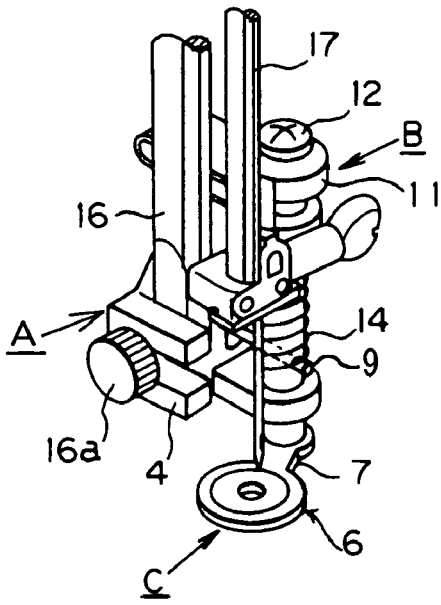

FIG. 7A is a perspective view of the free work pressing device for sewing machine, a presser bar of sewing machine to which the free work pressing device is to be mounted, and a needle bar with a needle shown as separately. FIG. 7B is a perspective view of the free work pressing device for sewing machine which is mounted to the presser bar so as to cooperate with the needle bar with the needle for the stitching operation.

Figure 8:
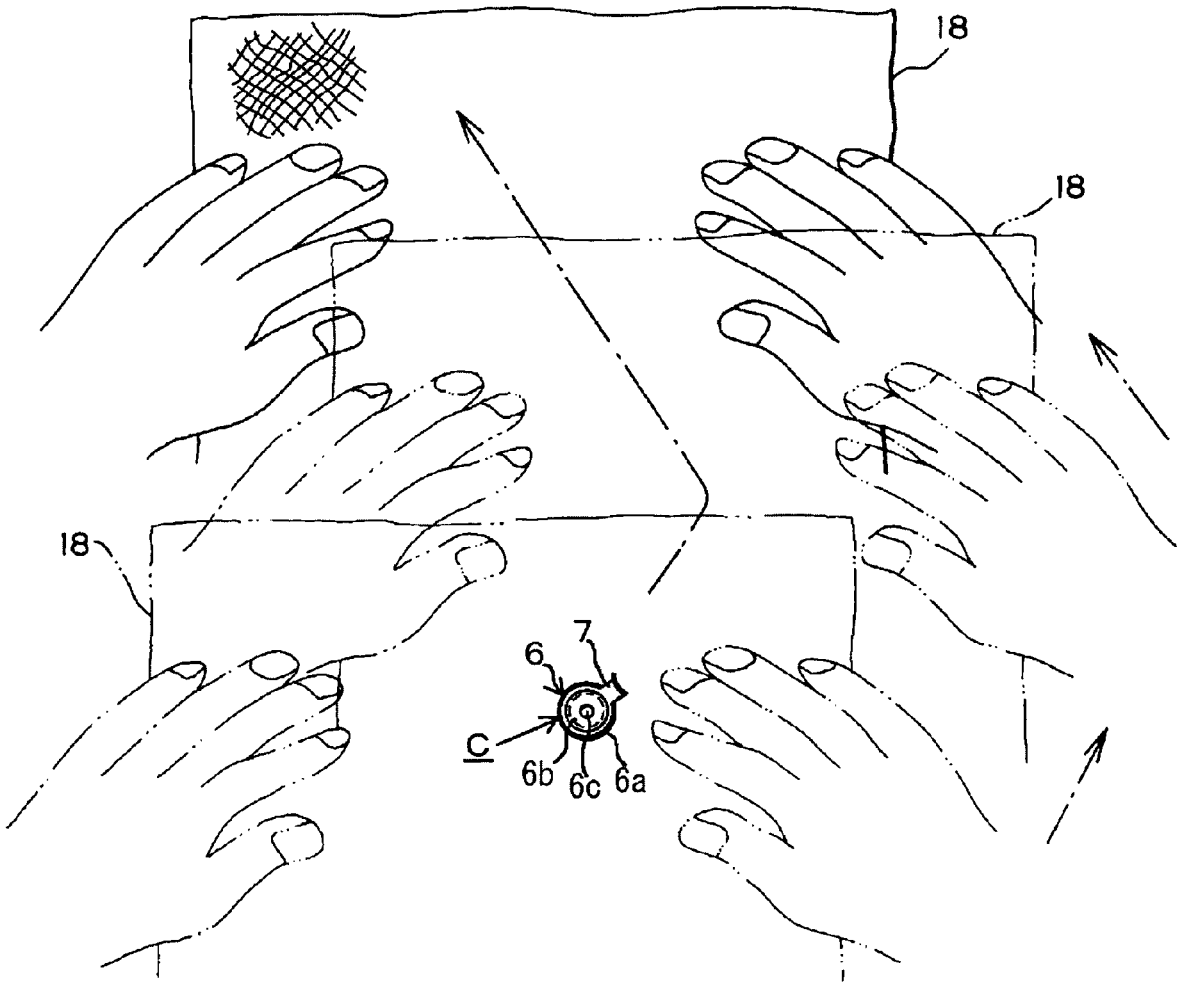

FIG. 8 is a plan elevational view of the situation for performing the stitching operation with use of the free work pressing device for sewing machine of the invention.

DESCRIPTION OF THE PREFERRED EMBODIMENTS

Figure 1A:
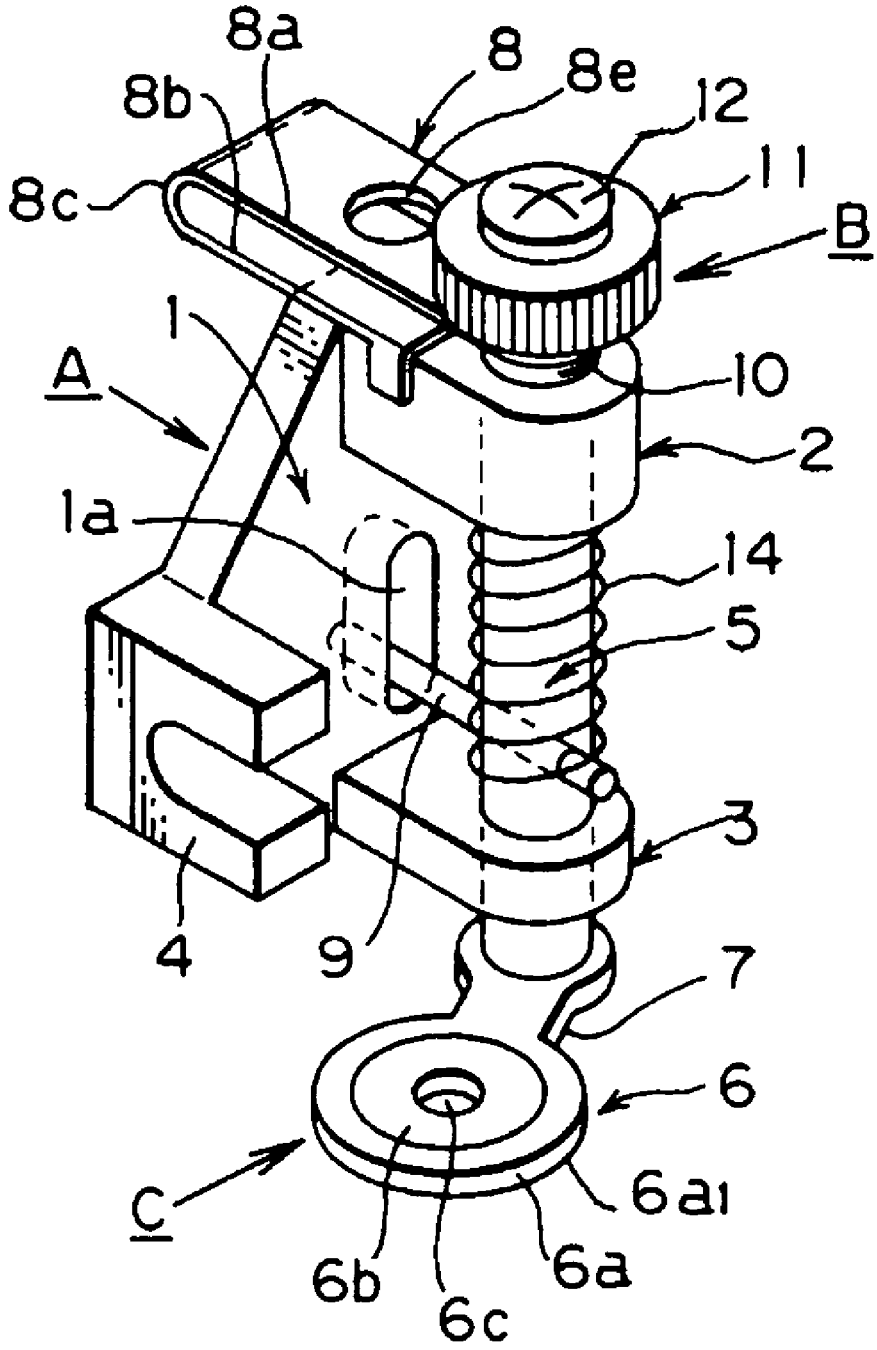
Figure 1B:
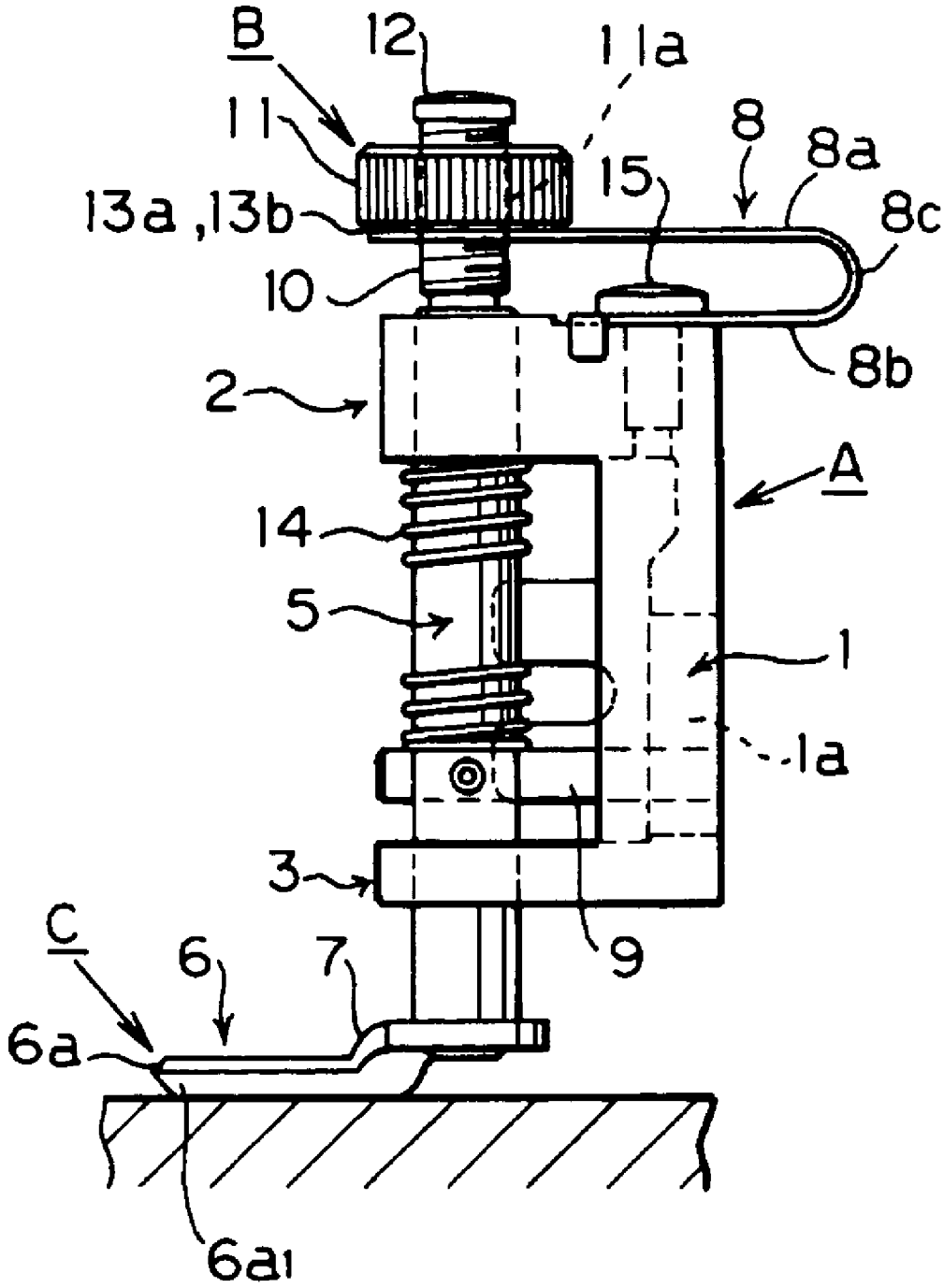
Figure 1C:
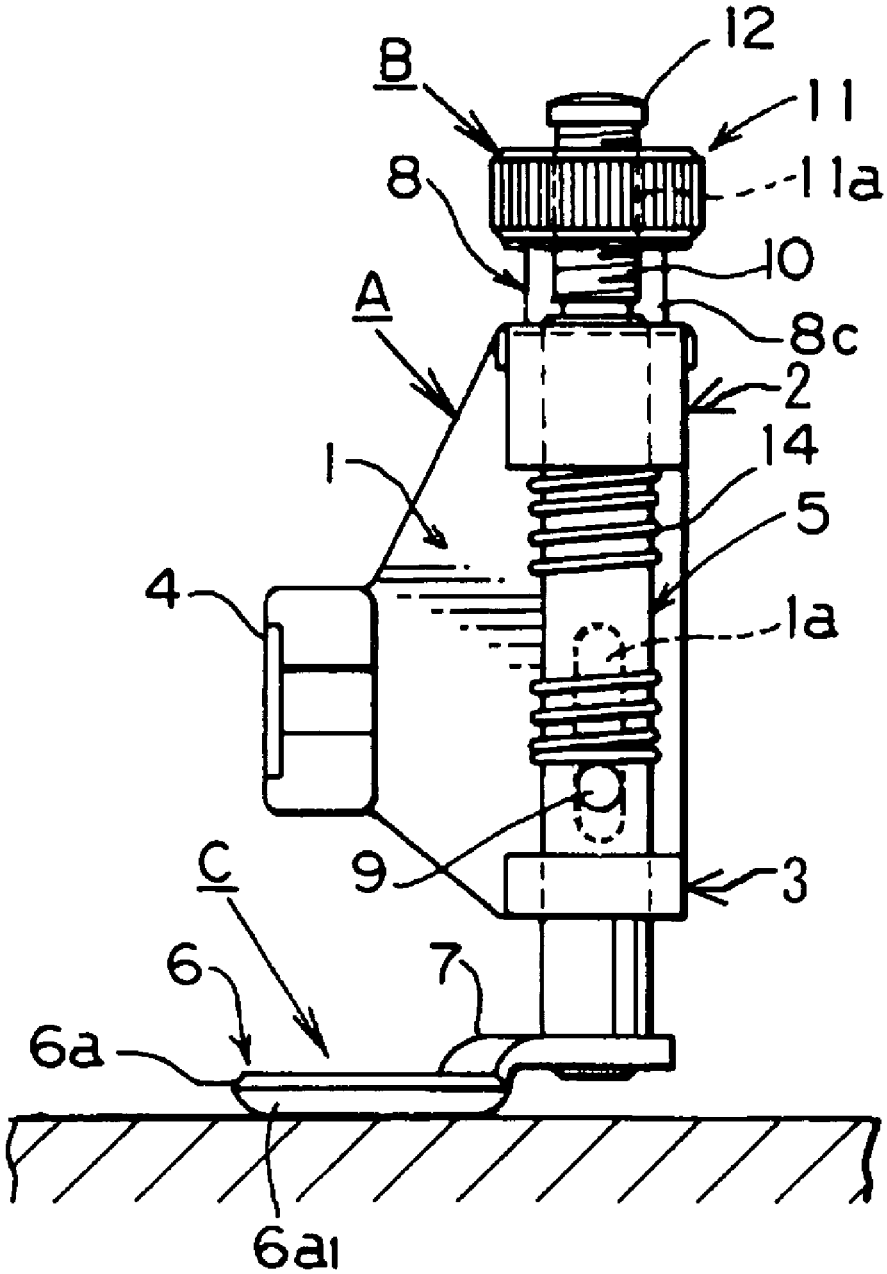
Figure 1D:
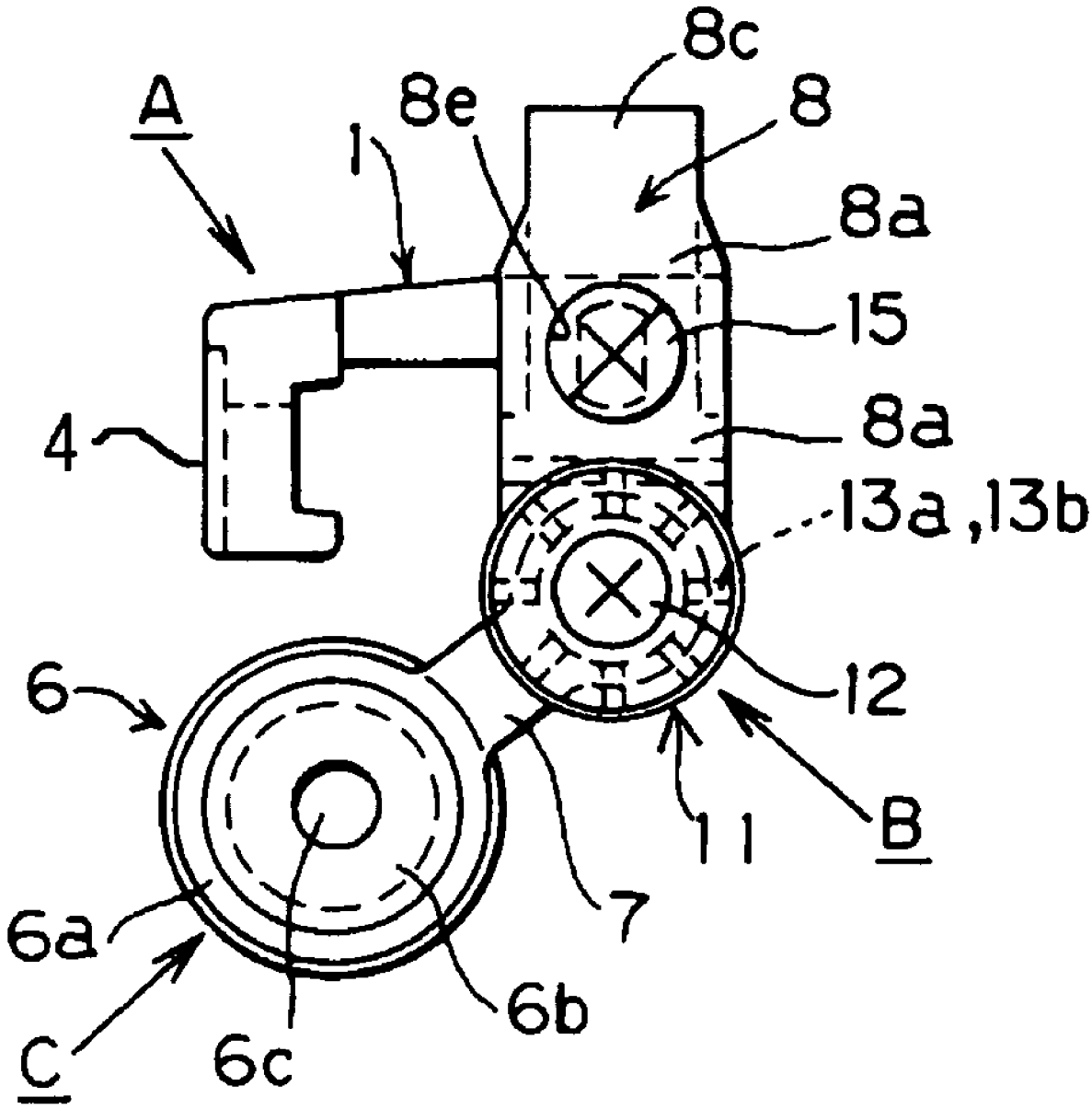
Figure 2A:
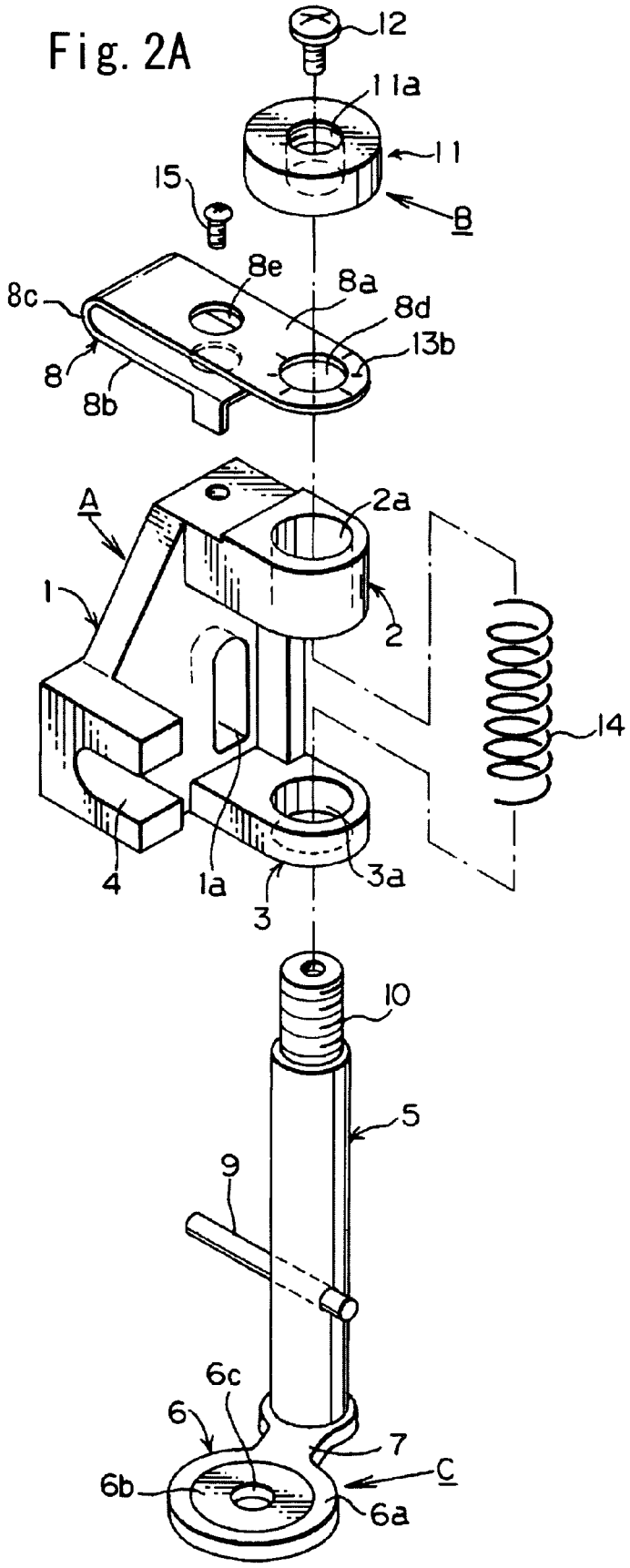

The invention will be described in detail in reference to the attached drawings. As particularly shown in FIG. 1, the free work pressing device for sewing machine according to the invention is substantially composed of a holding portion A, a slide shaft 5, an elastic member 14, an adjust mechanism B and a work pressing foot C. As shown in FIG. 2A, the holding portion A includes a holder body 1 of flat plate that is formed with an upper holder 2 and a lower holder 3.

The upper holder 2 and the lower holder 3 are formed as laterally extended from the vertical flat plate 1 and have a through hole 2*a* and a through hole 3*a* respectively for supporting the slide shaft 5 so that the same may be slidingly moved in the axial direction. Further the holder body 1 is formed with a connecting portion 4 by which the holder body 1 is connected to a presser bar 16 of sewing machine which is arranged adjacent a needle bar in parallel therewith. The holder body 1, the upper holder 2, the lower holder 3 and connecting portion 4 are formed in one body with a metal material.

The slide shaft 5 is inserted into the through holes 2*a*, 3*a* respectively of the upper holder 2 and the lower holder 3 and may be slidingly moved up and down. The adjust mechanism B are manipulated to adjust the vertical position of the work pressing foot C as will be described in detail.

As shown in FIGS. 1 and 2, the slide shaft 5 has the work pressing foot C secured to the lower end thereof. The work pressing foot C is composed of a work pressing part 6 and an arm 7 by which the work pressing foot C is secured to the lower end of the slide shaft 5. Further the work pressing part 6 is composed of an outer circular frame 6*a* and an inner work pressing plate 6*b*.

The work pressing plate 6*b* is transparent and is made of a synthetic resin such as plastic or the like. As shown in FIGS. 1D and 2A, the work pressing plate 6*b* has a hole 6*c* formed at the center thereof through which the machine needle is vertically reciprocated. The arm 7 is an elongated plate having one end secured to the lower end of the slide shaft 5. Thus the work pressing part 6 is laterally extended from the slide shaft 5.

The work pressing part 6 has a cup shaped appearance with the cup having the outer peripheral side so formed as to be progressively reduced toward the circular bottom 6*a*1 that is of a diameter smaller than the diameter of the upper circular frame 6*a*. Conversely, the outer peripheral side is progressively increased from the diametrically small circular bottom 6*a*1 toward the diametrically larger upper circular frame 6*a*.

Anyway it is preferable that the work presser part 6 is of the shape that the peripheral edge of the upper frame 7 is horizontally extended out over the circular bottom 6*a*1 with the predetermined space provided between the upper frame 6*a* and the lower bottom 6*a*1 as defined by the outer peripheral side. This is because the work will not be caught by the upper peripheral edge of the frame 6*a* when the work is moved under the circular bottom 6*a*1 in optional directions while the free kilt stitching operation is performed.

A buffer 8 is mounted to the upper holder 2 of the work presser holding portion A. The buffer 8 is made of a metal plate which is bent substantially into a U-shape having an upper plate 8*a* and a lower plate 8*b* extending in parallel with each other from the intermediate bent portion 8*c*, so that the upper plate 8*a* may elastically move to and away from the lower plate 8*b* as is compressed when a load is applied.

The upper plate 8*a* of the buffer 8 has a hole 8*d* formed therewith through which the upper portion of the slide shaft 5 is inserted. The lower plate 8*b*, which is shorter than the upper plate 8*a*, is secured to the upper holder 2 by means of a screw 15 or the like. In this connection, the upper plate 8*a* has a hole 8*e* formed therewith for manipulating the screw 15 by means of a driver or the like therethrough.

The slide shaft 5 has a guide pin 9 passed therethrough laterally of the axial direction. The guide pin 9 is inserted into a vertically elongated guide groove 1*a* formed at the holding portion A so as to guide the slide shaft 5 to move up and down in cooperation with the guide groove 1*a* while preventing the slide shaft 5 from making axial rotation. Thus the slide shaft 5 is extended as inserted through the upper and lower holes 2*a*, 3*a* of the holding portion A and through the hole 8*d* of the buffer 8 which is secured to the upper end of the holding portion A by the screw 15 while the guide pin 9 is inserted into the vertically elongated guide groove 1*a* of the holding portion A. Further, an elastic member, that is a coil spring 14, is arranged around the slide shaft 5 and between the upper holder 2 of the holding portion A and the guide pin 9 and normally gives a downward pressure to the slide shaft 5.

Figure 3A:
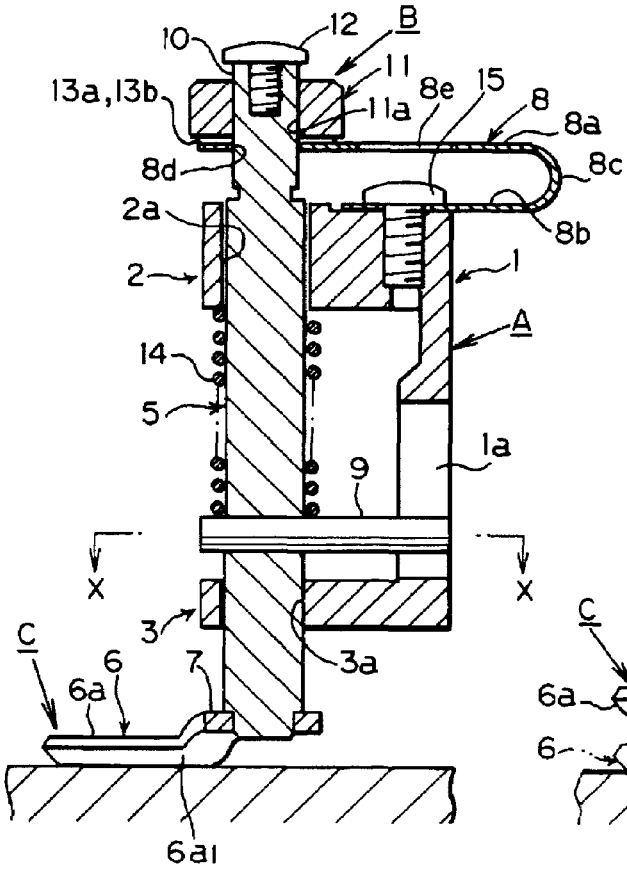
FIG. 3A is a side elevational view of the free work pressing device for sewing machine shown in vertical section, wherein the work pressing foot is raised.
Figure 3B:
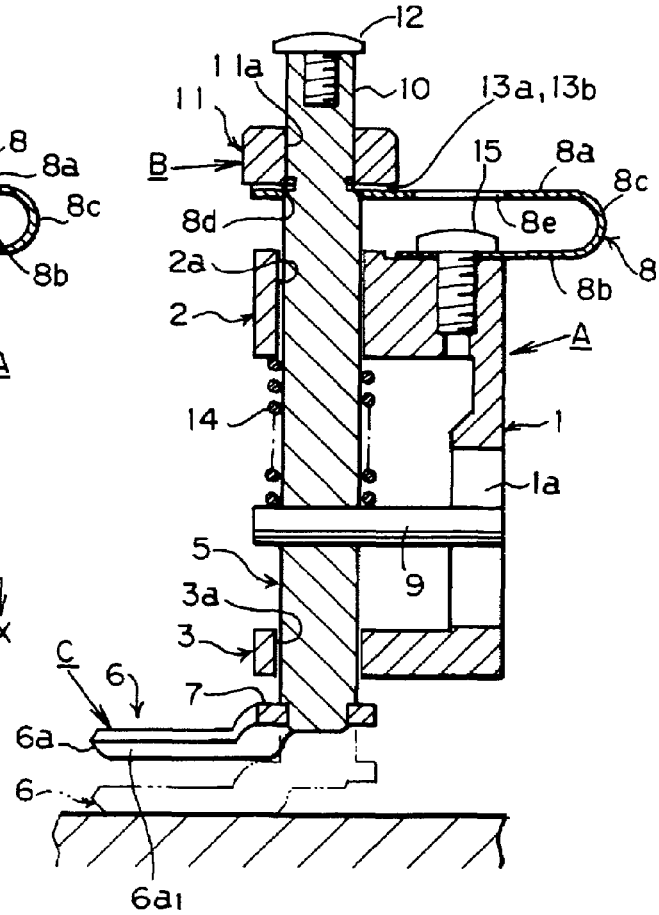
FIG. 3B is a side elevational view of the free work pressing device for sewing machine shown in vertical section, wherein the work pressing foot is lowered.
Figure 4:
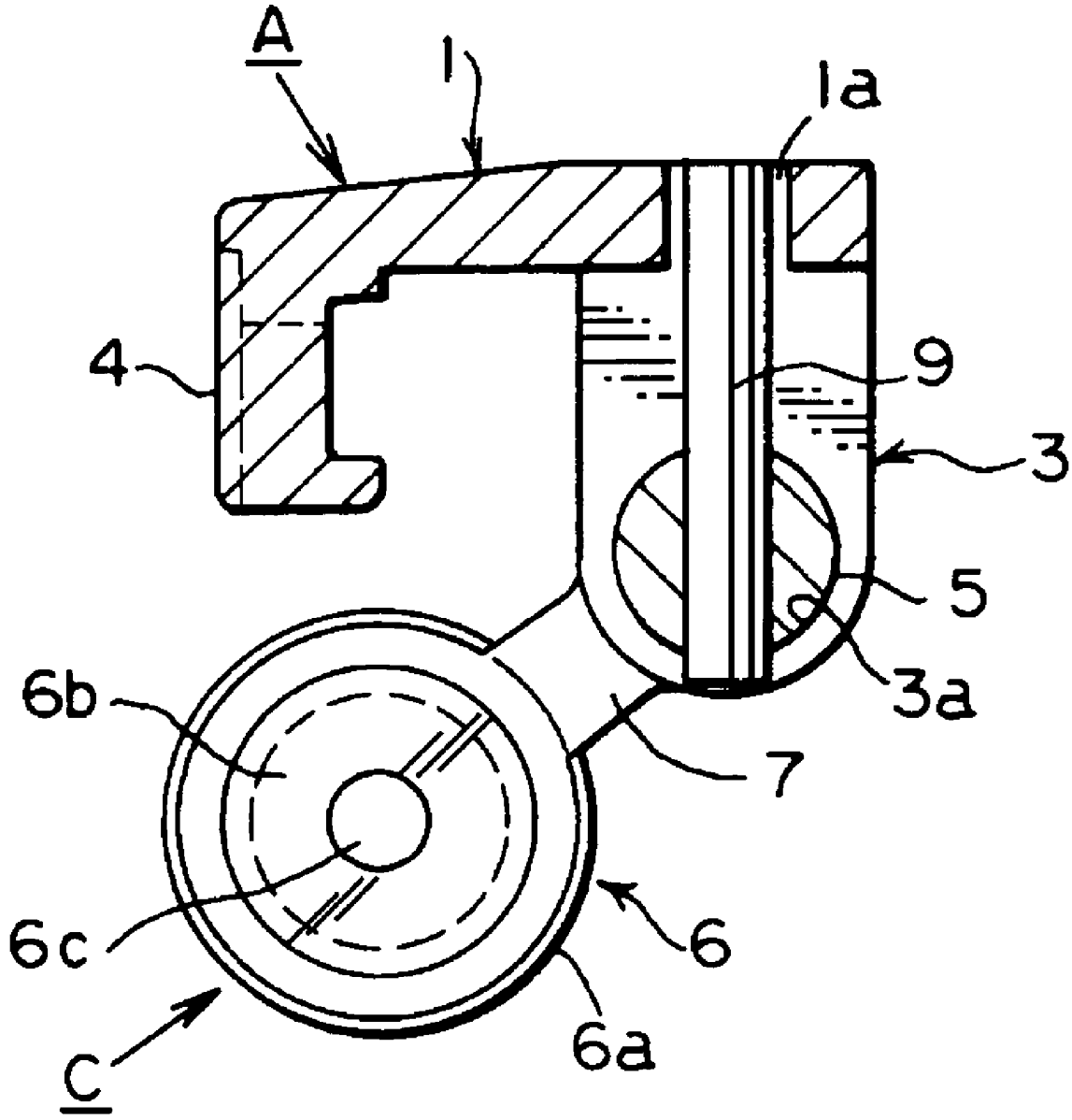
FIG. 4A is a plan elevational view of the free work pressing device for sewing machine taken from the arrow marks X-X of FIG. 3A.
Figure 5:
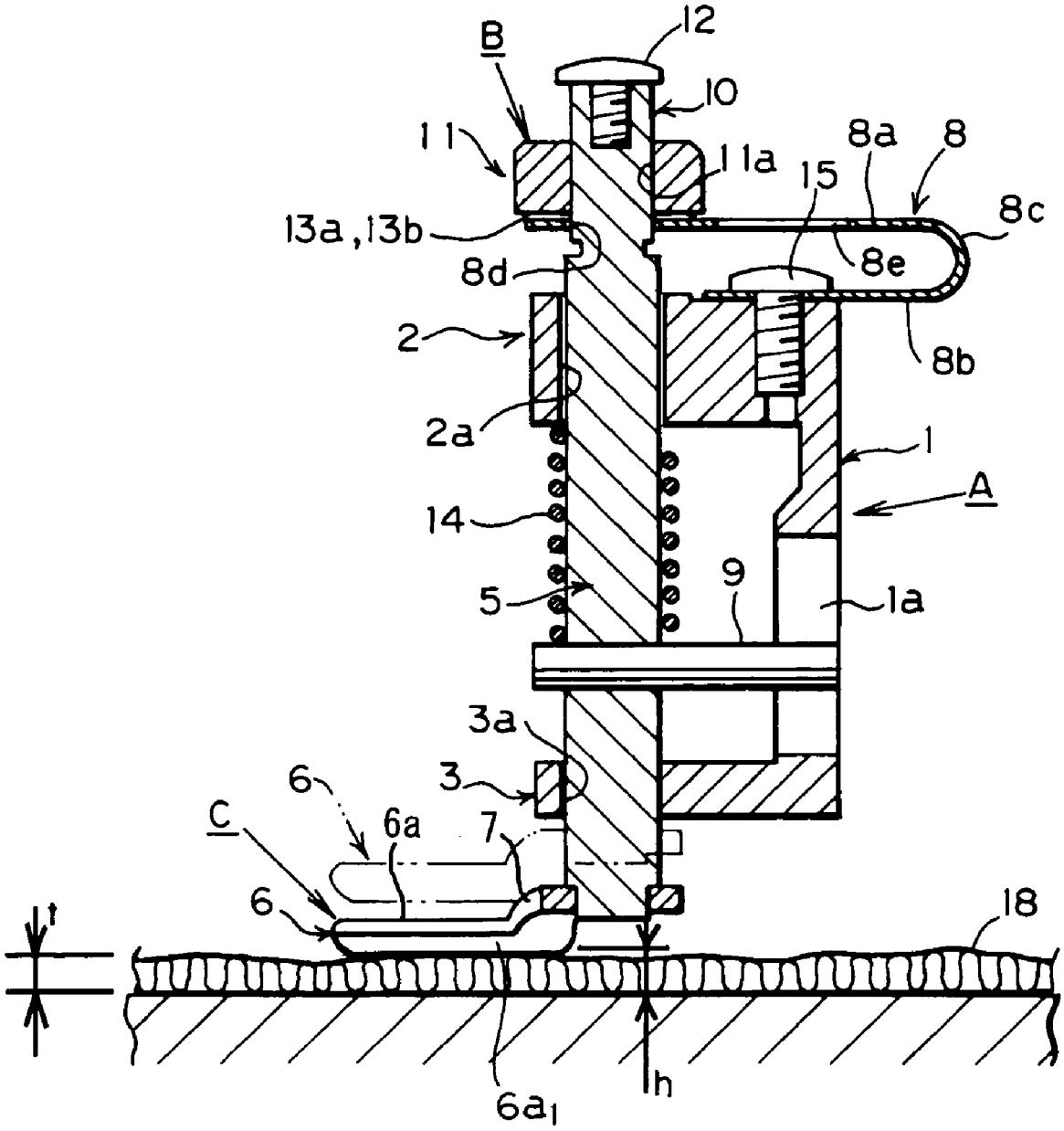
FIG. 5A is a side elevational view of the free work pressing device sewing machine shown in vertical section, wherein the work presser foot is shown as having adaptability to the variation in the thickness of the work that is to be stitched.
Figure 6:
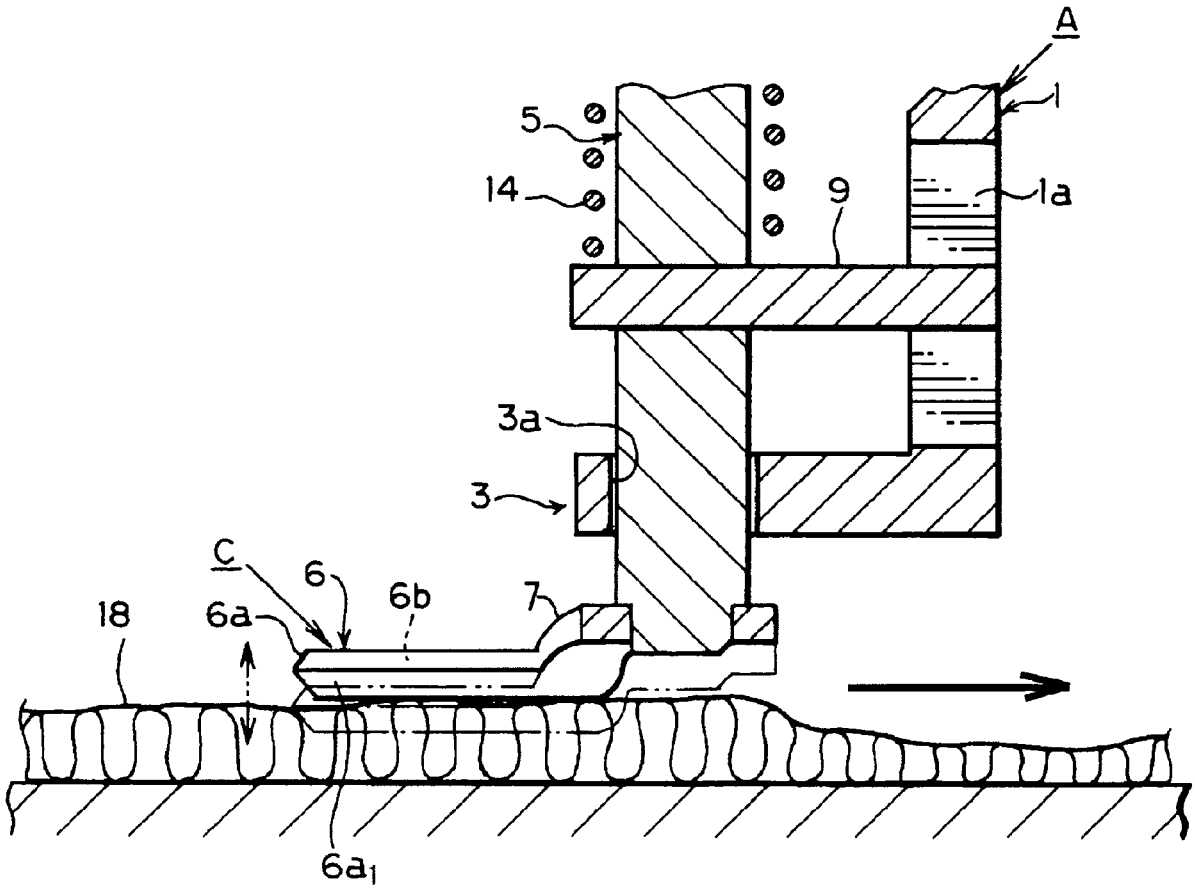
FIG. 6 is a side elevational view of the essential part of the free work pressing device for sewing machine shown in vertical section, wherein the work pressing foot is shown as being moved as yielding up and down in dependence upon the variation in the thickness of the work.

The slide shaft 5 has an upper part 10 that is diametrically reduced and has a periphery that is axially threaded as shown in FIGS. 2A, 3A, 3B. An adjust screw member 11 that is generally cylindrical and has an axially extended hole 11*a* with an inner periphery 11*a* that is threaded. The adjust screw member 11 is mounted to the upper threaded part 10 of the slide shaft 5 and is in threaded engagement with the upper threaded part 10 and thus forms the adjust mechanism B.

The adjust mechanism B is provided to adjust the vertical position of the work pressing foot C. Precisely the adjust screw member 11 is rotated against the buffer action of the buffer 8 to move the slide shaft 5 in the vertical direction against and under the control of the action of coil spring 14, thereby to adjust the vertical position of the work pressing foot C relative to the work 18, the work pressing foot C being secured to the lower end of the slide shaft 5. Further a stopper 12 is secured to the upper end of the slide shaft 5. The stopper 12 has a head which is diametrically lager than the diameter of the upper part 10 of the slide shaft 5, so that the adjust screw member 11 may be prevented from being disengaged out from the upper part 10 of the slide shaft 5.

As shown in FIG. 2, the adjust screw member 11 has a plurality of engaging projections 13*a* formed at the lower side thereof. On the other hand, the upper plate 8*a* of the buffer 8 has a plurality of engaging grooves 13*b* formed at the upper side thereof. Since the adjust screw member 11 and the upper plate 8*a* of the buffer 8 are arranged in the condition that the engaging projections 13*a* and the engaging grooves 13*b* are in engagement with one another with buffer action, the adjust screw member 11 may be intermittently rotated and may be held as stopped at an optional position.

Figure 2B:
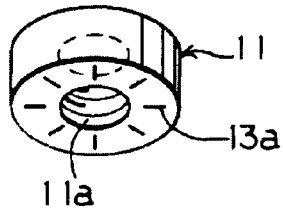
Figure 2C:
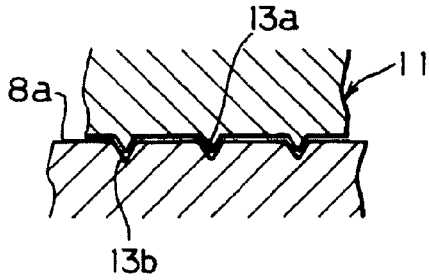

Actually as shown in FIGS. 1D, 2B, 2C, the plurality of engaging projections 13*a* are formed at the lower side of the adjust screw 11 and radially of the hole 11*a*. On the other hand, The plurality of engaging grooves 13*b* are formed at the upper side of the upper plate 8*a* of the buffer 8 and radially of the hole 8*d*. Further the adjust screw 11 and the upper plate 8*a* of the buffer 8 are arranged in the condition that the engaging projections 13*a* and the engaging grooves 13*b* are in fitted engagement with one another with buffer action applied. Therefore, the engaging projections 13*a* and the engaging grooves 13*b* will cooperate to enable the adjust screw 11 to be intermittently rotated and to be held as stopped at an optional position.

According to the invention, the free work pressing device for sewing machine is used as shown in FIG. 7. First of all, the holder body 1 is mounted to the sewing machine by securing the connecting portion 4 to the presser bar 16 at a predetermined position thereof by means of a set screw 16*a* such that the needle attached to the lower end of the needle bar 17 may pass through the center hole 6*c* of the work pressing part 6.

Subsequently, the adjust screw member 11 is rotated to vertically move the slide shaft 5, thereby to adjust the vertical position of the work pressing foot C relative to the thickness t of the work 18 that is to be stitched. Namely it is decided that the position of the work pressing foot C will come to the height h corresponding to the thickness t of the work 18 which is placed on the needle plate under the work pressing foot C. Then the machine switch is turned on to start the sewing machine, and the work 18 is moved relative to the needle in the horizontal plane and in the optional directions as shown in FIG. 8 in accordance with the design of the pattern to be stitched. Thus the free kilt stitching operation is performed. As to the variation in the thickness of the work 18, the work pressing foot C may smoothly movable as yielding up and down in dependence upon the variation of the thickness of the work against and under the control of the coil spring 14.

The invention being thus described, it will be obvious that the same may be varied in many ways. Such variations are not to be regarded as a departure from the spirit and scope of the invention, and all such modifications are intended to be included within the spirit of the following claims.

What is claimed is:

1. A free work pressing device for a sewing machine comprising:

a holding portion for mounting the free work pressing device to a presser bar of the sewing machine;

a slide shaft supported by the holding portion so as to be axially movable in a vertical direction;

a work pressing foot secured to a lower end of the slide shaft;

an elastic member for pressing the slide shaft axially in a downward direction relative to the holding portion; and an adjust mechanism for adjusting a vertical position of the slide shaft relative to a work piece which is to be stitched.

2. The free work pressing device for a sewing machine as defined in claim 1, wherein the adjusting mechanism comprises:

an upper threaded part of the slide shaft; and an adjust screw member having an axially extended hole with an inner periphery that is threaded, the adjust screw member being in threaded engagement with the upper threaded part of the slide shaft and being rotated to move the slide shaft axially up and down relative to the work that is to be stitched.

3. The free work pressing device for a sewing machine as defined in claim 2, wherein the adjusting mechanism includes a buffer arranged on an upper end of the holding portion, the buffer being in engagement with the adjust screw member.

4. The free work pressing device for a sewing machine as defined in claim 3, further comprising engaging means provided between the adjust screw and the buffer to enable the adjust screw to be intermittently rotated and to be held at a position.

5. The free work pressing device for a sewing machine as defined in claim 1, wherein said adjust mechanism adjusts said work pressing foot to a fixed height according to a thickness of the work piece.

6. The free work pressing device for a sewing machines as defined in claim 1, wherein said work pressing foot does not move according to a vertical movement of a needlebar of the sewing machine.

7. A sewing machine, comprising:

a presser bar;

a free work pressing device for a sewing machine comprising:

a holding portion for mounting the free work pressing device to said presser bar;

a slide shaft supported by the holding portion so as to be axially movable in a vertical direction;

a work pressing foot secured to a lower end of the slide shaft;

an elastic member for pressing the slide shaft axially in a downward direction relative to the holding portion; and an adjust mechanism for adjusting a vertical position of the slide shaft relative to a work piece which is to be stitched.

8. The sewing machine as defined in claim 7, wherein the adjusting mechanism comprises:

an upper threaded part of the slide shaft; and an adjust screw member having an axially extended hole with an inner periphery that is threaded, the adjust screw member being in threaded engagement with the upper threaded part of the slide shaft and being rotated to move the slide shaft axially up and down relative to the work that is to be stitched.

9. The sewing machine as defined in claim 8, wherein the adjusting mechanism includes a buffer arranged on an upper end of the holding portion, the buffer being in engagement with the adjust screw member.

10. The sewing machine as defined in claim 9, further comprising engaging means provided between the adjust screw and the buffer to enable the adjust screw to be intermittently rotated and to be held at a position.

11. The sewing machine as defined in claim 7, wherein said adjust mechanism adjusts said work pressing foot to a fixed height according to a thickness of the work piece.

12. The sewing machines as defined in claim 7, wherein said work pressing foot does not move according to a vertical movement of a needlebar of the sewing machine.

13. An adjustment device for a sewing machine, the sewing machine comprising a holding portion for mounting the free work pressing device to a presser bar of the sewing machine, a slide shaft supported by the holding portion so as to be axially movable in a vertical direction, a work pressing foot secured to a lower end of the slide shaft, and an elastic member for pressing the slide shaft axially in a downward direction relative to the holding portion, said adjustment mechanism comprising:

an adjust mechanism for adjusting a vertical position of the slide shaft relative to a work piece which is to be stitched.

14. The adjustment device as defined in claim 13, wherein the adjusting mechanism comprises:

an upper threaded part of the slide shaft; and an adjust screw member having an axially extended hole with an inner periphery that is threaded, the adjust screw member being in threaded engagement with the upper threaded part of the slide shaft and being rotated to move the slide shaft axially up and down relative to the work that is to be stitched.

15. The adjustment device as defined in claim 14, wherein the adjusting mechanism includes a buffer arranged on an upper end of the holding portion, the buffer being in engagement with the adjust screw member.

16. The adjustment device as defined in claim 14, further comprising engaging means provided between the adjust screw and the buffer to enable the adjust screw to be intermittently rotated and to be held at a position.

17. The adjustment device as defined in claim 13, wherein said adjust mechanism adjusts said work pressing foot to a fixed height according to a thickness of the work piece.

18. The adjustment device as defined in claim 13, wherein said work pressing foot does not move according to a vertical movement of a needlebar of the sewing machine.

19. A free work pressing device for a sewing machine comprising:

a holding portion for mounting the free work pressing device to a presser bar of the sewing machine;

a slide shaft supported by the holding portion so as to be axially movable in a vertical direction;

a work pressing foot secured to a lower end of the slide shaft;

an elastic member for pressing the slide shaft axially in a downward direction relative to the holding portion;

an adjust means for adjusting a vertical position of the slide shaft relative to a work piece which is to be stitched.

20. The free work pressing device for a sewing machine according to claim 19, wherein said adjust means adjusts said work pressing foot to a fixed height according to a thickness of the work piece.

* * * * *